US007789582B2

(12) United States Patent
Babel et al.

(10) Patent No.: US 7,789,582 B2
(45) Date of Patent: Sep. 7, 2010

(54) APPLICATOR DEVICE

(75) Inventors: Guenther Babel, Nuremberg (DE); Britta Lorenz, Nuremberg (DE); Klaus Droegsler, Hoechstadt/Aisch (DE)

(73) Assignee: Schwan-Stablio Cosmetics GmbH & Co. KG, Heroldsberg (DE)

( * ) Notice: Subject to any disclaimer, the term of this patent is extended or adjusted under 35 U.S.C. 154(b) by 1094 days.

(21) Appl. No.: 10/545,874

(22) PCT Filed: Apr. 4, 2005

(86) PCT No.: PCT/EP2005/003525

§ 371 (c)(1),
(2), (4) Date: Jun. 27, 2006

(87) PCT Pub. No.: WO2005/096871

PCT Pub. Date: Oct. 20, 2005

(65) Prior Publication Data

US 2006/0263139 A1 Nov. 23, 2006

(30) Foreign Application Priority Data

Apr. 5, 2004 (EP) ..... 04008250

(51) Int. Cl.
*B43K 5/06* (2006.01)

(52) U.S. Cl. ..... 401/175; 401/172; 401/265

(58) Field of Classification Search ..... 401/75, 401/76, 171, 172, 174, 175, 265; 222/386, 222/390

See application file for complete search history.

(56) References Cited

U.S. PATENT DOCUMENTS 3,256,980 A * 6/1966 Bau ..... 401/75
3,993,226 A * 11/1976 Pavenick ..... 222/327
5,653,338 A * 8/1997 Tani ..... 206/385
6,398,439 B1 6/2002 Szekely

FOREIGN PATENT DOCUMENTS

| | | |
|---|---|---|
| DE | 1813437 | 7/1969 |
| DE | 195 01 213 | 7/1996 |
| DE | 19501213 | 7/1996 |
| DE | 101 21 381 | 10/2002 |
| DE | 10121381 | 10/2002 |
| EP | 0 434 326 | 6/1991 |
| EP | 1273245 | 1/2003 |
| FR | 1 133 524 | 11/1968 |
| JP | 2002-034652 | 2/2002 |

* cited by examiner

*Primary Examiner*—David J Walczak
(74) *Attorney, Agent, or Firm*—Bachman & LaPointe, P.C.

(57) ABSTRACT

An applicator device for a fluid, pasty, gel-like, wax-like or powder product, comprising an applicator having a working region, a first conveyor having a first conveyor element, a second conveyor having a second conveyor element, a first adjusting element and a second adjusting element which are rotatable relative to each other, wherein at least in a first operating position the first conveyor responds to rotation of the two adjusting elements relative to each other and at least in a second operating position the second conveyor responds to rotation of the two adjusting elements relative to each other, and actuation of the second conveyor causes axial displacement of the second conveyor element with respect to the first and second adjusting elements, more specifically by equal distances.

9 Claims, 10 Drawing Sheets

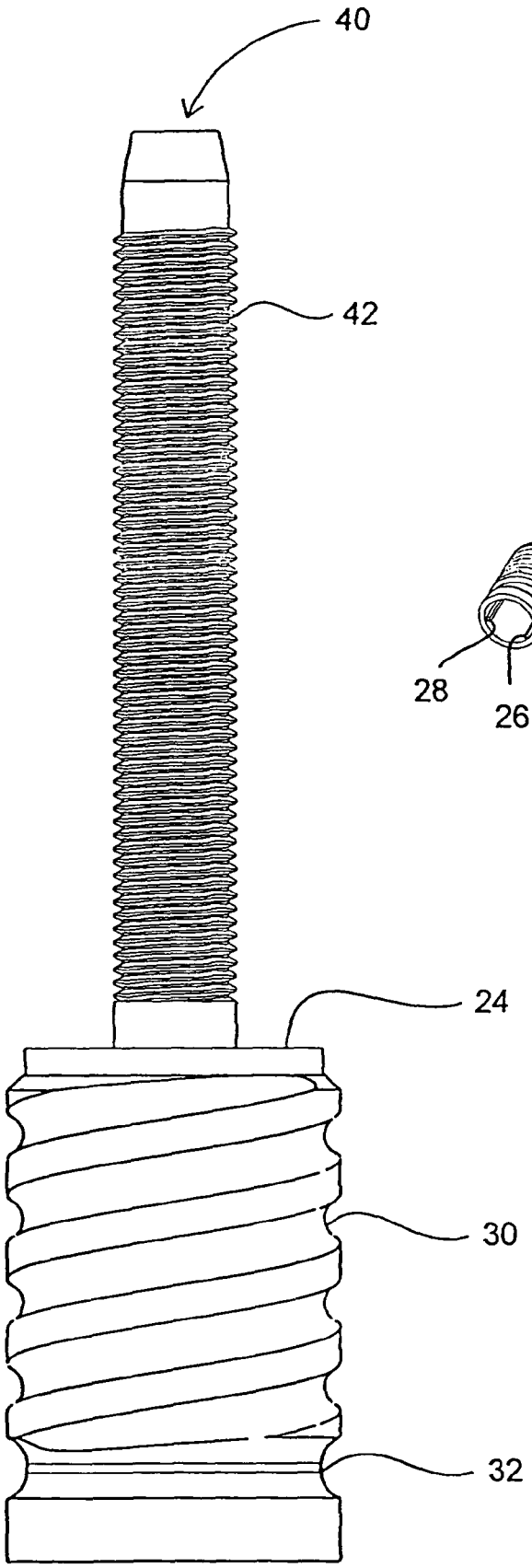
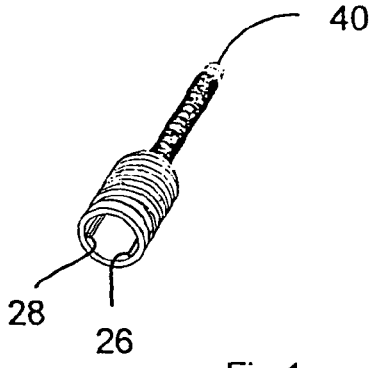
Fig.1a
Fig.1b

APPLICATOR DEVICE

BACKGROUND OF THE INVENTION

The invention concerns an applicator device for a fluid, pasty, gel-like, wax-like or powder product, comprising an applicator means having a working region, a first conveyor means having a first conveyor element, a second conveyor means having a second conveyor element, a first and a second adjusting element which are rotatable relative to each other, wherein at least in a first operating position the first conveyor means responds to rotation of the two adjusting elements relative to each other and at least in a second operating position the second conveyor means responds to rotation of the two control means relative to each other, and actuation of the second conveyor means causes axial displacement of the second conveyor element with respect to the first and second adjusting elements, more specifically by equal distances.

An applicator device of the kind set forth in the opening part of this specification is known, for example from EP 1 273 245 A1. In that arrangement the first control element is formed by a cartridge and the second control element is formed by a shaft. In a first operating condition (initial condition prior to first use) the cartridge is not completely filled with the product. Rather, there is a dead space. The first conveyor means serves to overcome the dead space wherein the second conveyor means serves for fine metering. The first conveyor element is identical to the second conveyor element. It is a piston which is axially slidable in the cartridge. When the piston is moved axially by actuation of the second conveyor means, it moves in the axial direction, more specifically by equal distances, with respect to both the cartridge and also the shaft. Therefore the cartridge and the shaft are not moved relative to each other in the axial direction.

The situation is different upon actuation of the first conveyor means for overcoming the dead space. More specifically in that case the piston is moved axially only with respect to the cartridge but not with respect to the shaft, and for that reason in that case the cartridge is moved axially with respect to the shaft. That therefore entails a reduction in the length of the overall applicator device.

Such a reduction is not desirable because an applicator device of the kind set forth in the opening part of this specification needs a given minimum length in order to be suitably handleable.

Therefore the object of the present invention is to develop the applicator device known from EP 1 273 245 A1 in such a way as to avoid a reduction in overall length upon actuation.

SUMMARY OF THE INVENTION

In accordance with the invention the stated object is attained in that actuation of the first conveyor means causes axial displacement of the first conveyor element with respect to the first and the second adjusting element, more specifically by equal distances.

In other words, measures are taken whereby actuation of the first conveyor means results in displacement of the first conveyor element both with respect to the first adjusting element and also with respect to the second adjusting element so that the adjusting elements are not displaced axially relative to each other. The axial length of the applicator device is accordingly maintained.

To simplify the applicator device it is provided in accordance with the invention that the first conveyor element is identical to the second conveyor element. It can be for example a piston.

As the first conveyor means preferably serves to overcome a dead space, it is preferably provided in accordance with the invention that the first conveyor means has a screwthread with a first screwthread element and a second screwthread element, wherein the two screwthread elements come out of engagement upon mutual displacement beyond a predetermined amount. In that case the predetermined amount is so selected that the two screwthread elements come out of engagement when the dead space has been overcome.

In this case the first screwthread element can be a helical groove adjoined by an annular groove. In such a case, upon displacement beyond the predetermined amount, the second screwthread element will travel out of the helical groove into the annular groove so that further displacement does not cause any further axial displacement of the two screwthread elements relative to each other.

In accordance with the invention the second conveyor means preferably (also) has a screwthread, more specifically with a third screwthread element and a fourth screwthread element.

In order further to simplify the applicator device according to the invention it is preferred that the third screwthread element is integral with the first screwthread element.

It can further be provided that the fourth screwthread element is integral with the conveyor element.

It can also be provided in accordance with the invention that the second screwthread element is integral with the first adjusting element.

In addition a simplification in the overall structure of the applicator device according to the invention is afforded if the second screwthread element is connected to the first adjusting element by way of a film hinge.

In accordance with a particularly preferred embodiment of the invention it is provided that the third screwthread element comes into engagement with the fourth screwthread element only when the first screwthread element is displaced with respect to the second screwthread element beyond a predetermined amount.

That achieves substantial independence for the two conveyor means from each other.

As the dead space, once it has been overcome, is not to recur again, there is preferably provided in accordance with the invention a device for securing the first conveyor means against return movement.

Comparable purposes are served by an elastic device which is preferably provided for biasing the first conveyor element and/or the second conveyor element in the conveyor direction.

As already mentioned above the first control element can be a cartridge while the second control element is preferably a shaft.

Finally in accordance with the invention there is preferably provided a protective cap which is rotationally coupled to the first adjusting element or the second adjusting element and screwed to the second or the first control element in such a way that unscrewing the cover cap leads to actuation of the first conveyor means and/or the second conveyor means.

It is possible in that way to provide that unscrewing the protective cap already leads to the product being conveyed in such a way that the dead space is overcome.

BRIEF DESCRIPTION OF THE DRAWINGS

The invention is described in further detail hereinafter by means of preferred embodiments by way of example with reference to the accompanying drawing in which.

DETAILED DESCRIPTION

Figure 1:
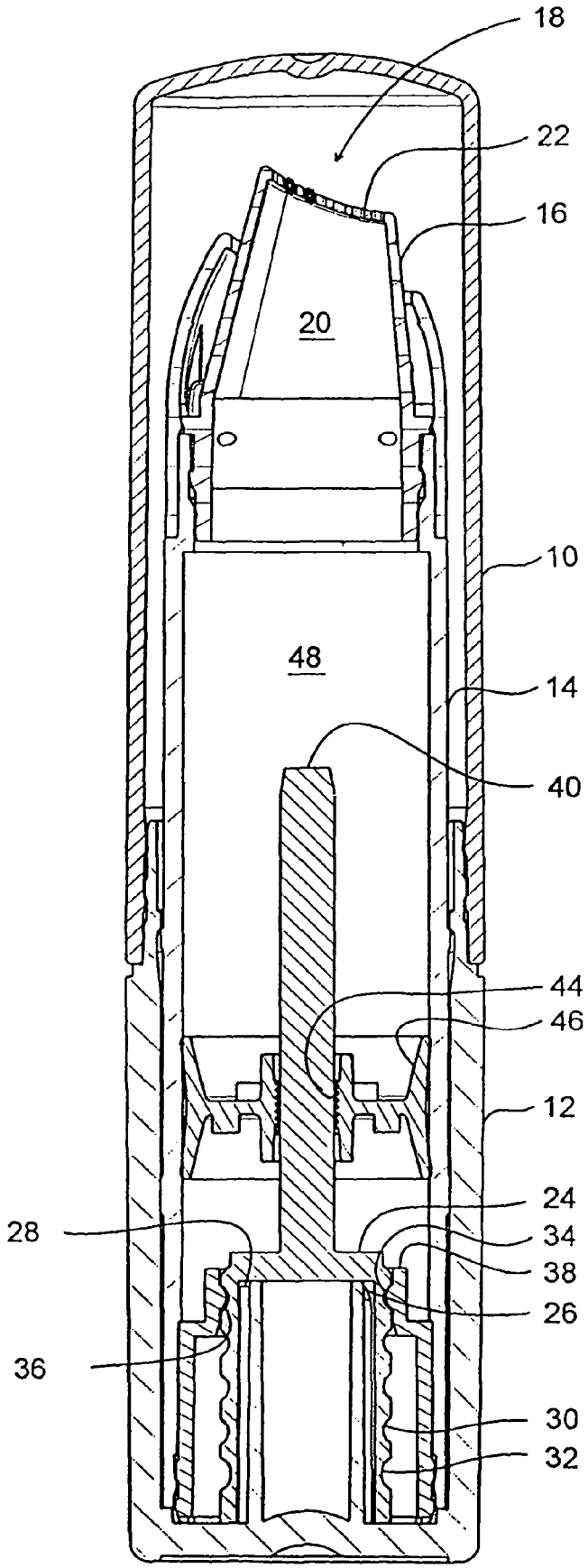
FIGS. 1 through 9 each show diagrammatic views in longitudinal section of preferred embodiments of the applicator device according to the invention.

The embodiment shown in FIG. 1 includes a protective cap 10 which is fitted on to a shaft 12. A cartridge 14 is inserted into the shaft 12. The shaft 12 and the cartridge 14 are rotatable relative to each other, more specifically about the longitudinal axis of the illustrated applicator device. At its front end the cartridge 14 carries an applicator means 16 with a working region 18. The working region 18 is communicated with the interior 20 of the applicator means 16 by way of passage openings. One of the passage openings is denoted by way of example by reference numeral 22.

Disposed in the shaft 12 at the rear end is a sleeve 24 which is rotationally coupled to the shaft 12 by way of ribs 26, 28 but is axially displaceable with respect to the shaft 12. The sleeve 24 carries a male screwthread in the form of a helical groove 30. The helical groove 30 is adjoined by an annular groove 32, see in particular F*igure* 1*b*. Engaging into the grooves 30 and 32 respectively are screwthread elements 34, 36 which are provided on a sleeve 38. The sleeve 38 is coupled to move with the cartridge 14.

A spindle 40 is integrally joined to the sleeve 24 and bears a male screwthread 42, see in particular F*igure* 1*b*. A female screwthread 44 on a piston 46 meshes with the male screwthread 42.

The spindle 40 is disposed in a storage means 48 which is delimited at its rear end by the piston 46 and which is formed by the interior of the cartridge 14. The storage means 48 serves to accommodate a pasty cosmetic product, such as for example lipstick.

In production, firstly the spindle 40 with the piston 46 carried thereon is inserted into the cartridge 14. Thereupon the cartridge 14 is filled with the cosmetic product. Therefore, the applicator means 16 is not filled with the cosmetic product, prior to the first use of the applicator device shown in FIG. 1. Rather, disposed in front of the storage means 48 is a dead space which firstly has to be overcome in order to make the applicator device ready for use.

The screwthread combination comprising the screwthread element 34 and the helical groove 30 serves to overcome that dead space. More specifically, when the cartridge 14 is rotated with respect to the shaft 12, that results in corresponding rotation of the sleeve 38 with respect to the sleeve 24, which, by virtue of the axial fixing of the sleeve 38 with respect to the cartridge 14, results in an axial movement of the sleeve 24, directed upwardly in FIG. 1, both with respect to the shaft 12 and also the cartridge 14. That axial movement in turn results in a corresponding axial movement of the piston 46 whereby the product in the storage means 48, overcoming the dead space, is conveyed into the interior 20 of the conveyor means 16, in the direction of the working region 18.

This mechanism which is of a particular kind and to which the initial stroke movement of the first and/or second conveyor means is always specific is also particularly suited to urging a sealing element which seals off the material supply container out of its rest position and thus opening the supply container.

As the above representation shows, the dead space is overcome by axial movement of the piston 46 both with respect to the cartridge 14 and also with respect to the shaft 12, so that axial movement of the cartridge 14 with respect to the shaft 12 does not occur. The axial length of the applicator device is therefore maintained while the dead space is being overcome.

The same applies for operation of the applicator device after the dead space has been overcome. More specifically, when the screwthread elements 34 and 36 reach the end of the helical groove 30, they pass into the annular groove 32. As soon as they are in the annular groove 32 further rotary movement of the cartridge 14 with respect to the shaft 12 no longer produces any further axial movement of the sleeve 24. Rather, this only involves axial movement of the piston 46 with respect to the cartridge 14 because the spindle 40 is rotated by way of the ribs 26 and 28 with the shaft 12 with respect to the cartridge 14 whereas the piston 46 is rotationally coupled with respect to the cartridge 14, for example by suitable biasing of the piston in the cartridge or by virtue of the piston being of an external contour which differs from a circular shape and the cartridge being of an internal contour which differs from a circular shape, in which respect in particular oval contours may be considered. It is however also possible to provide corresponding rib configurations, for example as in the case of the ribs 26 and 28. As the male screwthread 42 and the female screwthread 46 are of a considerably smaller pitch than the helical groove 30, fine metering of the cosmetic product takes place after the dead space has been overcome and after the screwthread elements 34 and 36 have moved into the annular groove 32. Accordingly the above-described mechanisms cause the cosmetic product to pass gradually from the storage means 48 by way of the interior space 20 and the passage openings 22 into the working region 18.

Although this is not shown in FIG. 1, nonetheless there may be provided a screwthread for coupling the protective cap 10 to the shaft 12, with the protective cap 10 being rotationally coupled at the same time to the cartridge 14 (for example by way of a rib configuration). In such a situation unscrewing of the protective cap 10 from the shaft 12 would already entail rotation of the cartridge 14 with respect to the shaft 12 so that the above-described dead space would thus be overcome.

FIG. 1 also does not show the structure in which the bottom of the shaft is for example open and it is thus possible to push the sleeve 28 and the piston coupled thereto forwardly by the volume of the dead space, by just the pressure of the fingers. In that case an abutment in the cartridge stops further forward movement after the dead space has been overcome and the device can be used for fine metering by subsequent rotary movement of the two adjusting elements.

Figure 2:
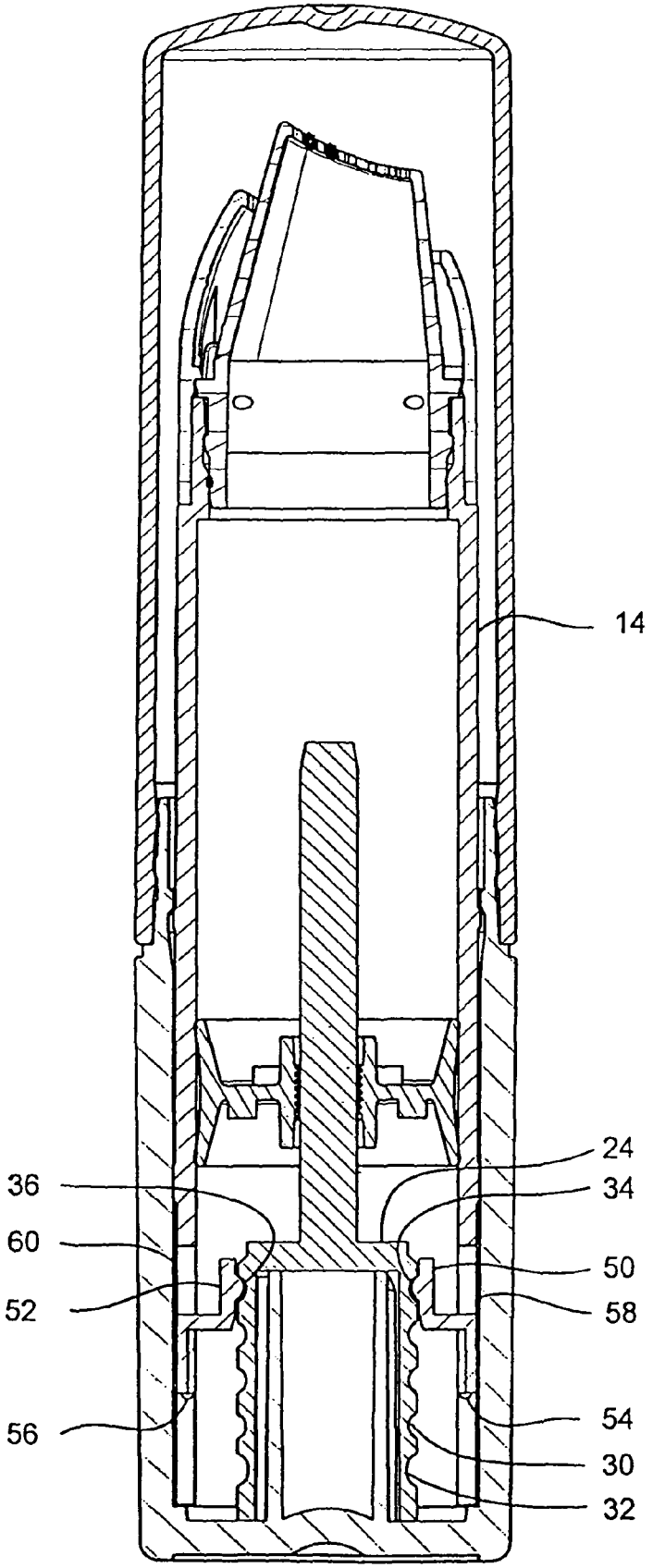

The applicator device shown in FIG. 2 substantially corresponds to that shown in FIG. 1, and for that reason it will not be described in detail here. Rather, attention will be directed hereinafter only to the differences: instead of the sleeve 38, the device has arms 50, 52 on which the screwthread elements 34, 36 are provided. The arms 50, 52 are connected to the cartridge 14 by way of film hinges 54, 56 and can therefore be formed integrally with the cartridge 14. The arms 50, 52 project into the cartridge 14 through windows 58, 60 so that the screwthread elements 34, 36 can come into engagement with the helical groove 30 and the annular groove 32 respectively.

The configuration shown in FIG. 2 has the advantage that the sleeve 24 can be pushed into the cartridge 14 without having to be screwed in because it is only after it has been pushed in that the arms 50, 52 are pivoted inwardly through the windows 58, 60.

In addition that makes it possible to save on a component.

Figure 3:
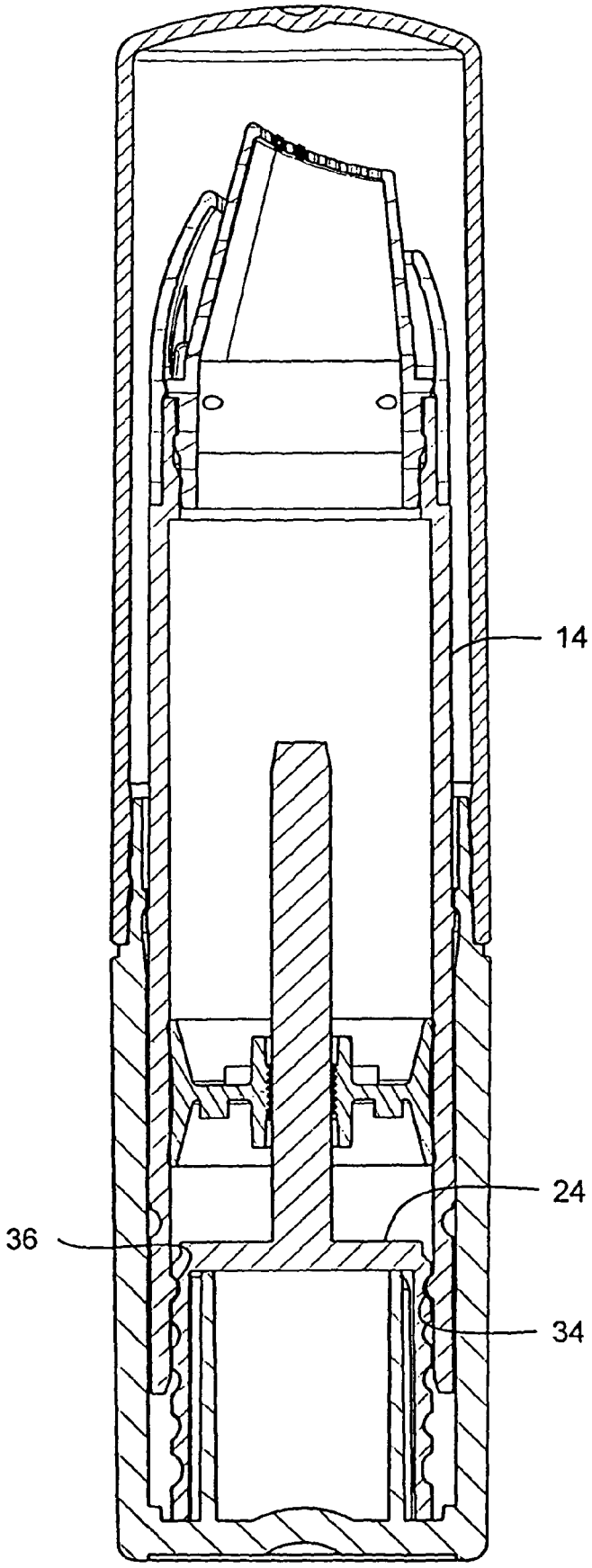

In the configuration shown in FIG. 3 the sleeve 24 is of a larger diameter in comparison with the configurations of FIGS. 1 and 2, whereby it is possible for the screwthread elements 34, 36 to be provided directly at the inside wall of the cartridge 14.

Figure 4:
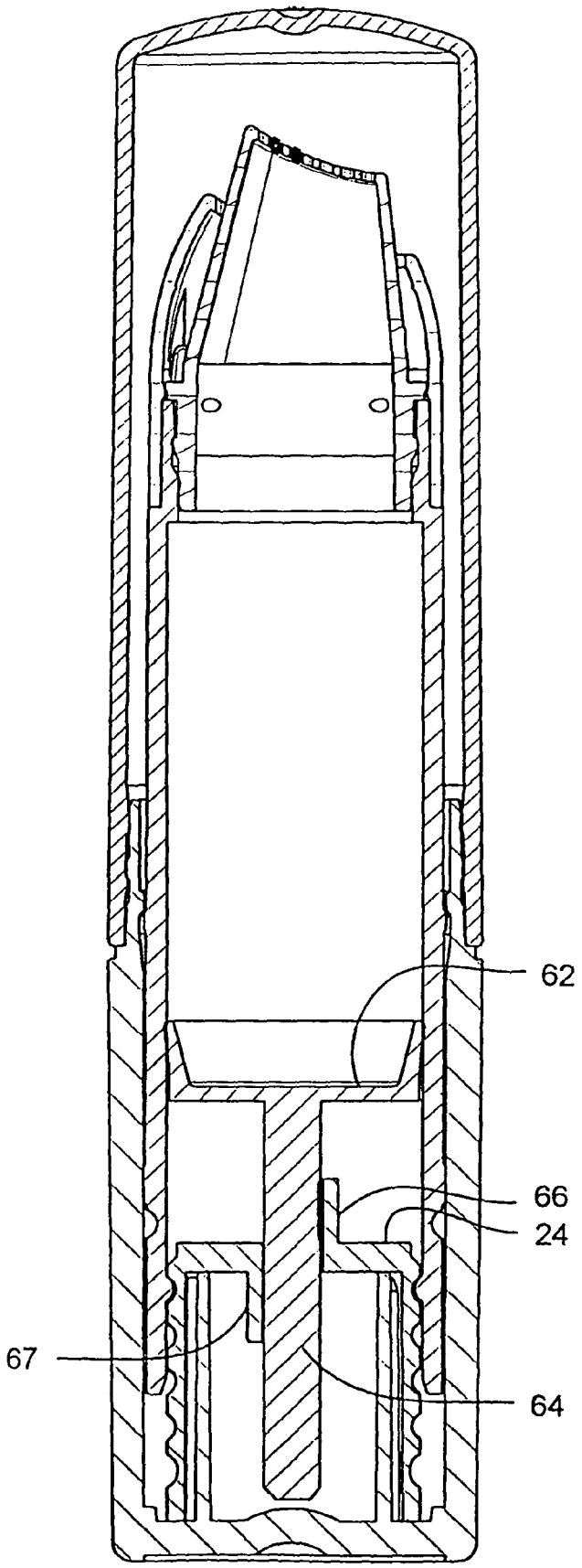

The embodiment shown in FIG. 4 has a piston 62 formed integrally with a spindle 64. A female screwthread on an arm 66 on the sleeve 24 meshes with a male screwthread (not shown in detail in the drawing) on the spindle 64. A further arm 67 on the sleeve 24 does not have a screwthread. That again achieves the advantage that the spindle 64 can be pushed into the sleeve 24 without having to be screwed in.

Figure 5:
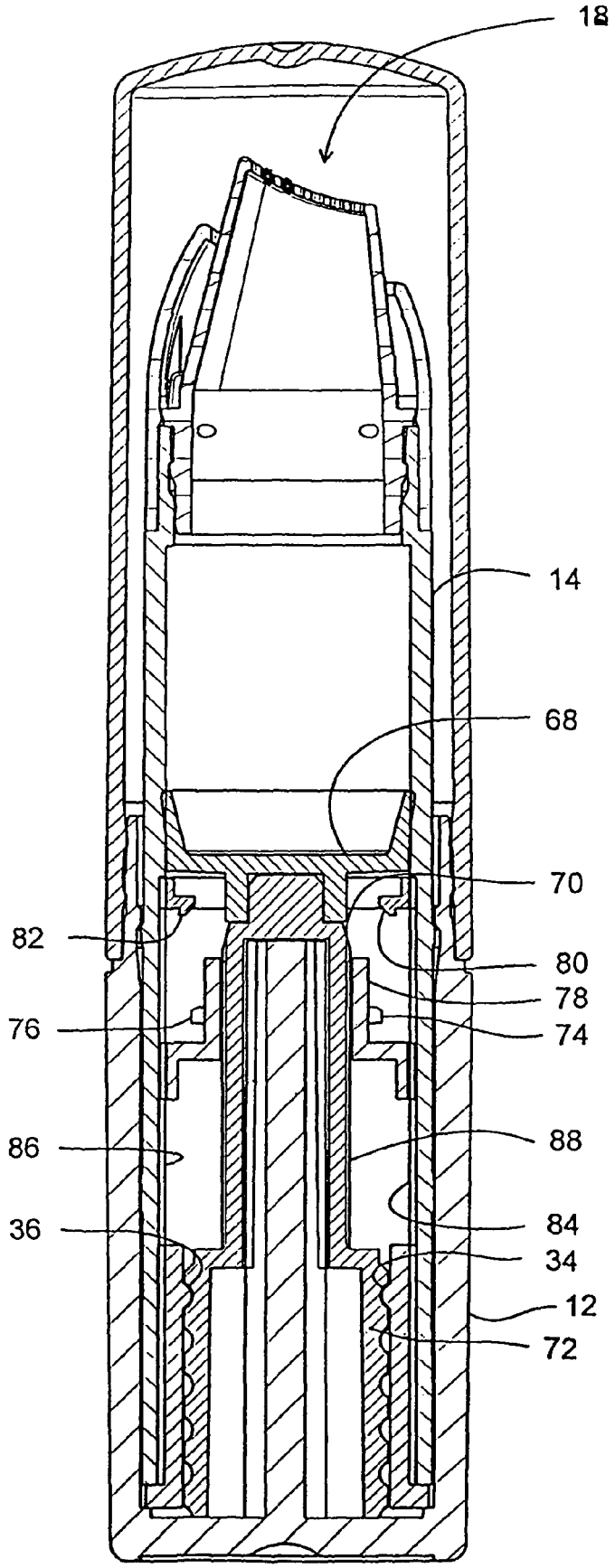

In the embodiment shown in FIG. 5—similarly to the embodiment of FIG. 4—a piston 68 is again axially coupled to a spindle 70 even if not formed integrally therewith. In comparison the spindle 70 is formed integrally with a sleeve 72 which, from the point of view of its function, corresponds to the sleeve 24 shown in FIGS. 1 through 4. Upon actuation firstly the spindle 70 together with the sleeve 72 will move upwardly in FIG. 5 in the axial direction. This time, the screwthread elements 34, 36 do not pass into an annular groove but come out of the screwthread element of the sleeve 72. In the course of that upward movement projections 74 and 76 on a sleeve 78 snap over projections 80, 82. In that way the screwthread elements for the second conveyor means are axially fixed. As the sleeve 78 is rotationally coupled to the cartridge 14 by way of a rib configuration 84, 86, further rotary movement of the cartridge 14 with respect to the shaft 12 has the result that the spindle 72 is moved upwardly in FIG. 5 by virtue of the sleeve 78 engaging into a male screwthread 88 on the spindle 70 and thus cosmetic product is conveyed by means of the piston 68 to the working region 18.

Axial fixing of the screwthread elements for the second conveyor means serves to make the device more robust, for example in the event of its being dropped.

In FIG. 5, in contrast to the previous concepts, for the first time the third screwthread element also implements an axial displacement. As a result forward displacement of the piston takes place independently of its biasing in the cartridge.

Figure 6:
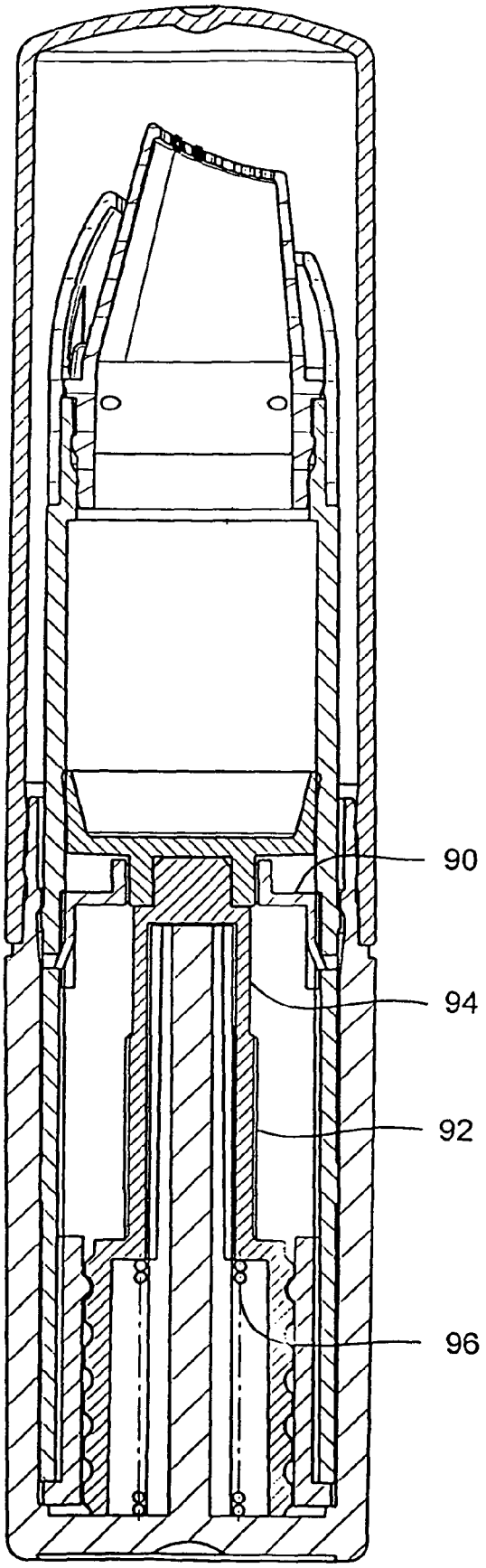

In the configuration shown in FIG. 6 a sleeve 90 carries a female screwthread which meshes with a male screwthread 92 on a spindle 94 only after the spindle 94 is raised to overcome the dead space. The spindle 94 is biased axially upwardly in FIG. 6 by means of a coil spring 96.

Figure 7:
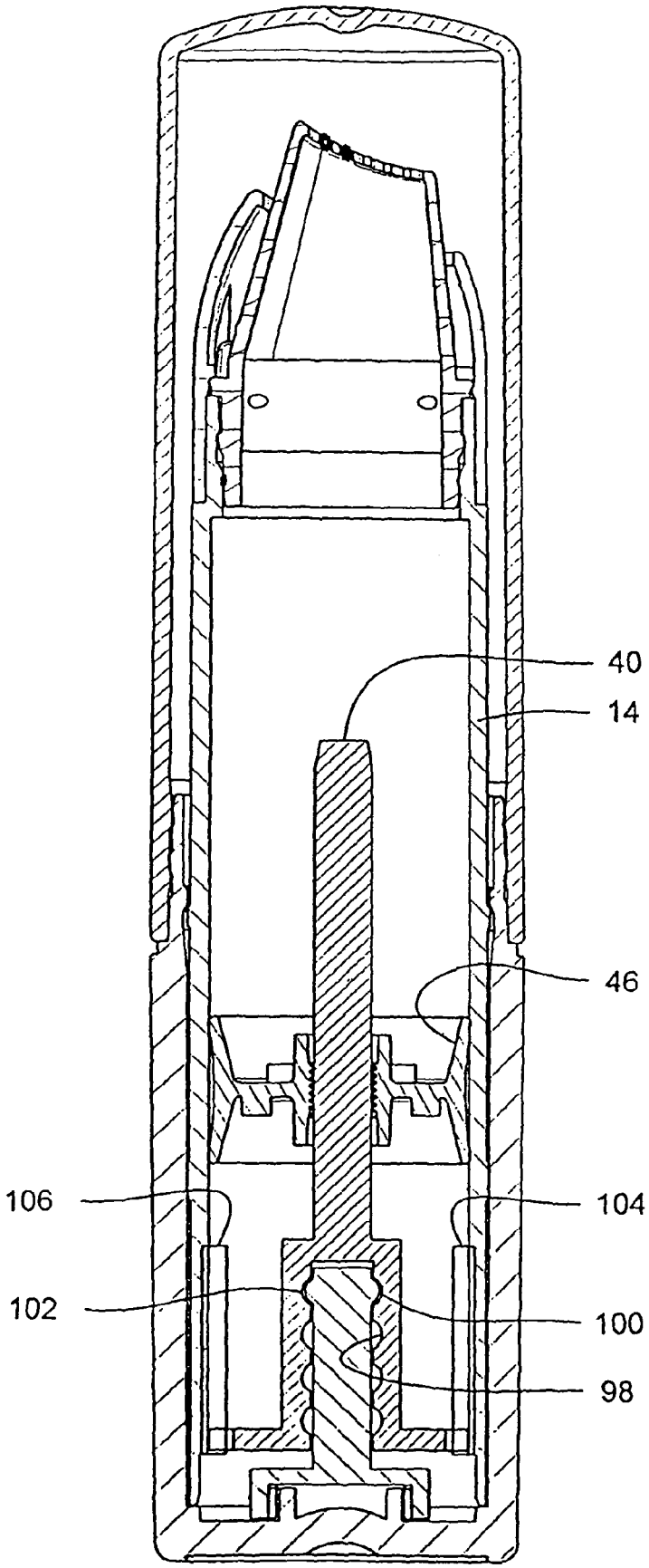

The configuration shown in FIG. 7 substantially corresponds to that shown in FIG. 1 but represents a mechanical reversal in a number of respects. More specifically, the male screwthread groove 30 of FIG. 1 is replaced by a female screwthread groove 98 into which engage male screwthread elements 100, 102. Ribs 104, 106 are provided in addition to the ribs 26, 28.

There is no counterpart in FIG. 7 to the annular groove 32 shown in FIG. 1. Rather the screwthread elements 100, 102 remain in engagement with the annular groove 98, even after the spindle 40 has been pushed axially out of engagement with the ribs 104, 106. The higher pitch angle between the piston 46 and the cartridge 14 and the frictional forces that this entails cause a torque to be applied to the spindle which can now rotate freely and thus causes the advance movement of the piston 46 which is non-rotationally fixed with respect to the cartridge 14.

Figure 8:
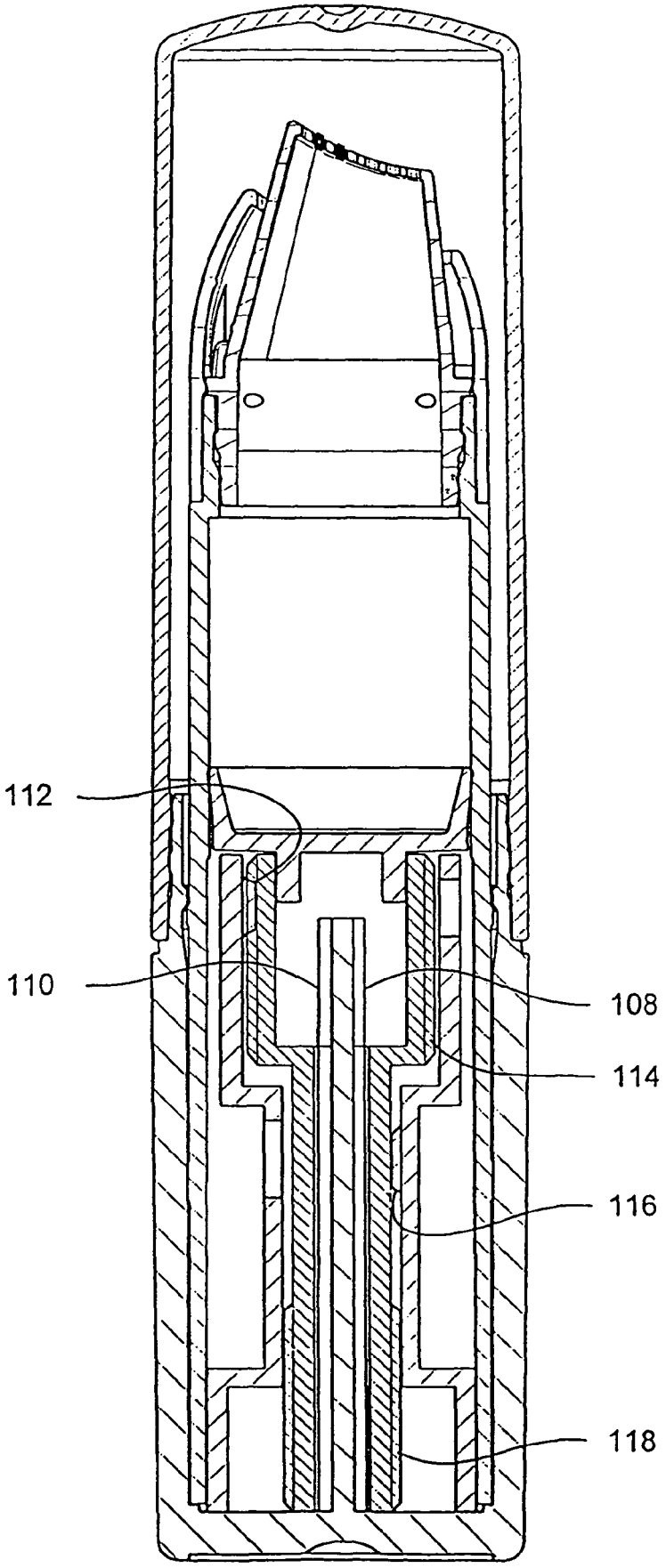

The embodiment shown in FIG. 8 has ribs 108, 110. A screwthread element 112 serves together with a screwthread 114 for displacement for overcoming the dead space. In comparison fine metering is afforded by a screwthread element 116 in conjunction with a screwthread 118. Otherwise the conditions essentially correspond to those shown in FIG. 5.

Figure 9:
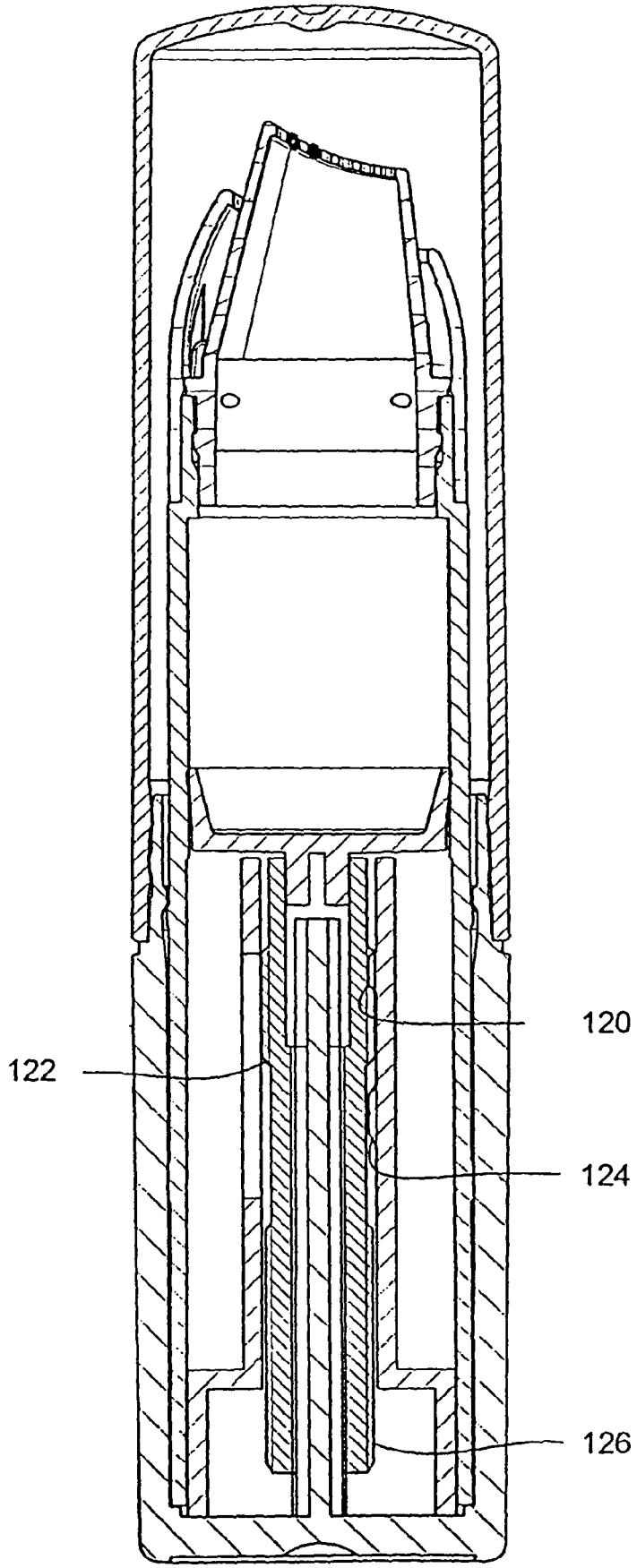

The embodiment shown in FIG. 9 substantially corresponds to that shown in FIG. 8 but with the difference that the pairs of screwthreads 120/122 and 124/126 are on a notional common peripheral cylindrical surface.

The features of the invention disclosed in the foregoing description, in the claims and in the drawing can be essential both individually and also in any combinations for implementing the invention in the various embodiments thereof.

The invention claimed is:

1. An applicator device for a fluid, pasty, gel-like, wax-like or powder product, comprising an applicator means having a working region, a first conveyor means having a conveyor element, a second conveyor means having the conveyor element, a first adjusting element and a second adjusting element which are rotatable relative to each other, wherein at least in a first operating position the first conveyor means responds to rotation of the two adjusting elements relative to each other and at least in a second operating position the second conveyor means responds to rotation of the two adjusting elements relative to each other, and actuation of the second conveyor means causes axial displacement of the conveyor element with respect to the first and second adjusting elements by essentially equal distances, wherein actuation of the first conveyor means causes axial displacement of the conveyor element with respect to both the first and the second adjusting element, wherein the conveyor means has a screwthread with a first screwthread element and a second screwthread element, wherein the two screwthread elements come out of engagement upon mutual displacement beyond a predetermined amount.

2. An applicator device as set forth in claim 1, wherein the axial displacement is by equal distances with respect to both the first and the second adjusting element.

3. An applicator device as set forth in claim 1, wherein the first screwthread element comprises a helical groove adjoined by an annular groove.

4. An applicator device as set forth in claim 1, wherein the conveyor means has a screwthread with a third screwthread element and a fourth screwthread element.

5. An applicator device as set forth in claim 4, wherein the third screwthread element is integral with the first screwthread element.

6. An applicator device as set forth in claim 5, wherein the fourth screwthread element is integral with the conveyor element.

7. An applicator device as set forth in claim 1, wherein the first adjusting element is a cartridge.

8. An applicator device as set forth in claim 1, wherein the second adjusting element is a shaft.

9. An applicator device as set forth in claim 1, wherein a protective cap is rotationally coupled to the first adjusting element or the second adjusting element in such a way that unscrewing the protective cap leads to actuation of the conveyor means.

* * * * *